United States Patent [19]

Bilyeu

[11] Patent Number: 4,492,525

[45] Date of Patent: Jan. 8, 1985

[54] PNEUMATIC FIRE PUMP PRESSURE CONTROLLER

[75] Inventor: Delford D. Bilyeu, Roanoke, Va.

[73] Assignee: Grumman Emergency Products, Inc., Roanoke, Va.

[21] Appl. No.: 467,599

[22] Filed: Feb. 18, 1983

[51] Int. Cl.[3] ..... F04B 49/00

[52] U.S. Cl. ..... 417/34; 169/13; 417/43; 417/63

[58] Field of Search ..... 169/13; 417/34, 44, 417/45, 63, 364, 43; 60/431

[56] References Cited

U.S. PATENT DOCUMENTS

| | | | |
|---|---|---|---|
| 3,544,235 | 12/1970 | Smith | 417/34 X |
| 3,786,869 | 1/1974 | McLoughlin | 417/34 X |
| 3,987,625 | 10/1976 | Swatty et al. | 417/34 X |
| 4,330,238 | 5/1982 | Hoffman | 417/34 X |

*Primary Examiner*—Edward K. Look

*Attorney, Agent, or Firm*—Richard G. Geib

[57] ABSTRACT

An electro-pneumatic variable control for fire pumper engine and pump discharge.

4 Claims, 2 Drawing Figures

PNEUMATIC FIRE PUMP PRESSURE CONTROLLER

BACKGROUND

Devices have been suggested by the prior art as seen by U.S. Pat. No. 3,544,235 to provide pressure control of a pump discharge of a fire truck pumper using pump pressure to provide engine throttle control to maintain pressure and prevent engine overspeed. It has even been suggested that the pump pressure may be biased against a desired fluid pressure for the control of still another fluid pressure supply that is used to control engine rpm as seen in U.S. Pat. No. 2,642,805. It has even been suggested by the prior art in U.S. Pat. No. 2,570,727 that an electrical control circuit be interposed in a pump governor system to activate and maintain governor control whenever there is being developed by the pump discharge above atmosphere.

SUMMARY

It is, therefore, a principle object of this invention to improve upon these prior art teachings by using a pressure differential switch connected across a pump inlet and discharge to activate a solenoid valve scheduling pneumatic pressure for engine throttle control to maintain pressure at a pre-selected level and to deactivate the solenoid valve upon their occurring a drop in pressure differential across the pump inlet and discharge of a predetermined amount.

DRAWING DESCRIPTION

FIG. 1 is a pictorial illustration of a fire truck pumper with which this invention finds utility; and FIG. 2 is a schematic illustration of the system comprising this invention.

DETAILED DESCRIPTION

Figure 1:
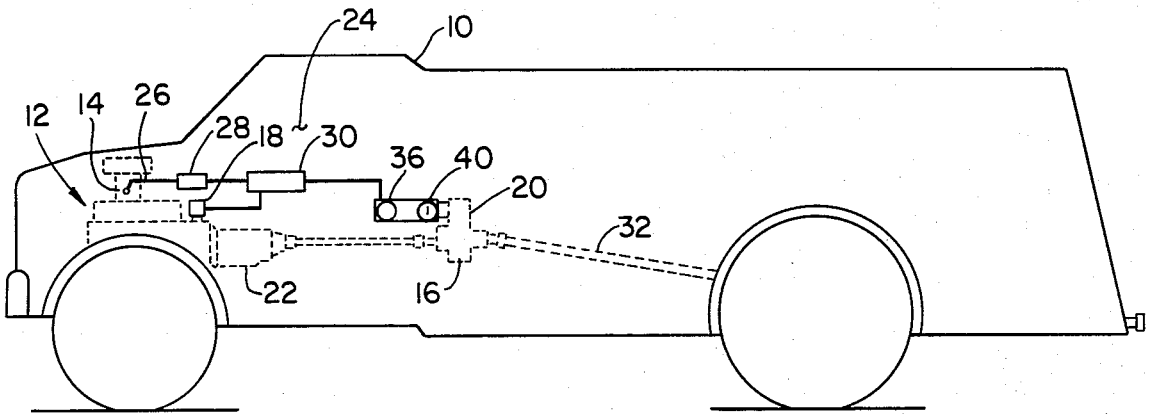
Figure 2:
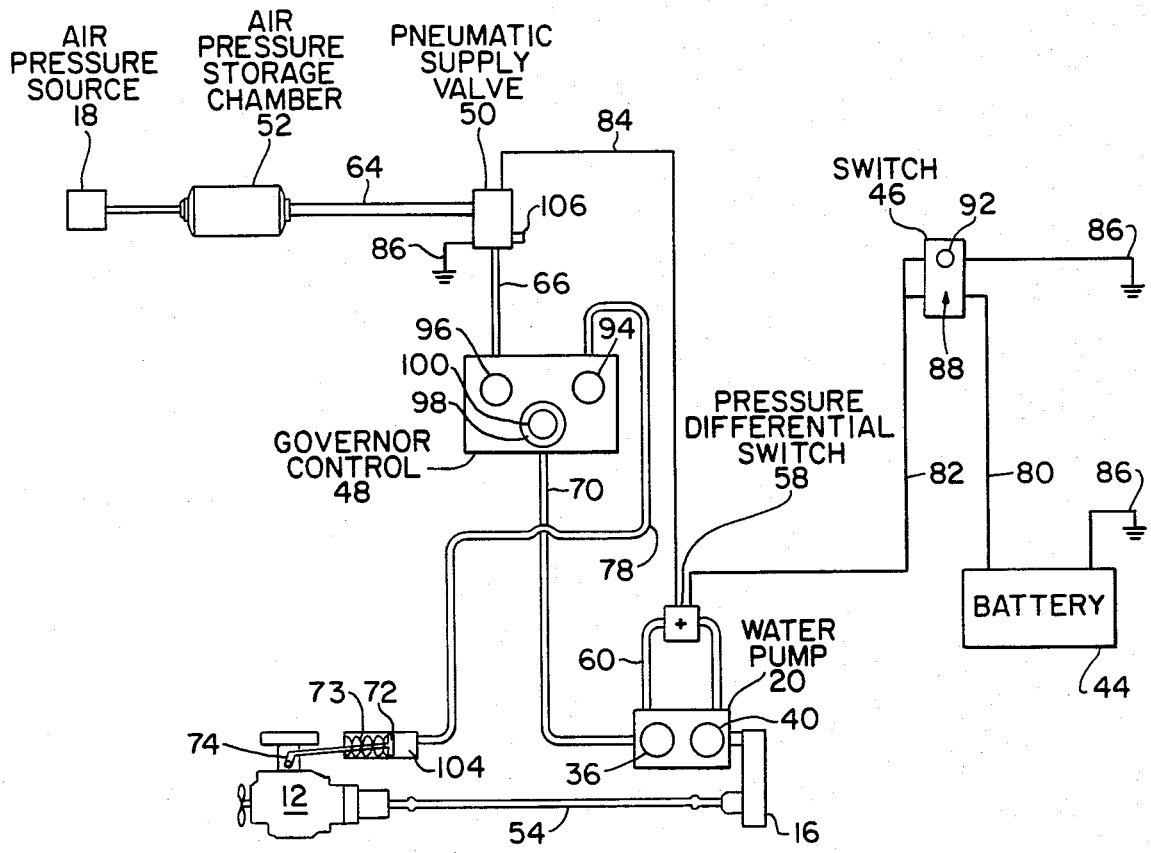

With more particular reference to FIG. 1 there is shown a fire truck pumper 10 having an engine 12 with a fuel control 14 a source of air pressure 18, a water pump 20 and a transmission 22. The engine fuel control is linked by means not shown to an accelerator pedal in the cab 24 and by link 26 to a pneumatic throttle actuator 28 under control of an electro-pneumatic system 30 to be more particularly described with reference to FIG. 2. A drive shaft 32 connects the transmission 22 to the rear wheels 34 of the fire truck for driving same. It will be readily understood by those skilled in the art that the transfer case 16 providing power take-off from engine 12 will allow the engagement of the water pump 20 when it is desired to deliver water pressure from outlet 36 connected to the pump. The pump has an outlet 40 to receive water for the pump inlet couplings familiar to those skilled in the art will be used at outlet 36 and inlet 40 for hose connectors.

With reference now to FIG. 2 there is shown again the engine 12, pump 20 and source of air pressure 18 from FIG. 1 connected with the vehicle battery 44, a switch 46, a governor control 48 such as controller 1C07N made by Ametek Controls Division of Feasterville, Penna., a pneumatic supply solenoid valve 50 and an air pressure storage chamber 52. A drive links shaft 54 the engine and water pump via transfer case 16. A pressure differential switch 58 is connected by conduits 60 and 62 across the inlet and discharge sides of the pump 20. This pressure differential switch 58 is connected between switch 46 and solenoid valve 50 for control of air pressure to control 48 from storage chamber 52 via conduits 64 and 66. Conduit 70 communicates the control 48 to water pump discharge pressure at outlet 36. The system further includes conduit 78 between the control 48 and actuator 28 for control of throttle lever 74 of fuel control 14 via link 76. The electrical connection of the battery to the switches 46 and 58 and valve 50 is by lines 80, 82, 84 and 86.

Switch 46 is a simple on-off switch with toggle lever 88 and power-on indicator 92. Controller 48 includes an air supply pressure gauge 96, an air application pressure gauge 94 and, an adjustable pneumatic pressure scheduling ring 98 about a water pump discharge pressure gauge 100.

OPERATION

In operation, a fireman, after the fire truck pumper has reached the fire scene, will establish water supply to the suction side of poump 20 at inlet 40 and engage the water pump drive via transfer case 16 by a lever, not shown as will be familiar to those skilled in the art. Thereafter, he or she will turn on switch 88 to connect the battery to the differential switch 58. As soon as pump discharge pressure reaches a predetermined level to overcome inlet pressure, valve 58 closes the circuit to operated solenoid valve 50 to port air pressure to control 48. The air pressure will be communicated via control 48 to throttle actuator 28 to force its piston 72 to overcome its spring 73 to move throttle lever 74 to increase the engine rpm to cause pump 20 to increase discharge pressure flow at outlet 36 of the fire truck. When the discharge pressure, as shown by gauge 100 is at that set on scheduling ring 98, controller 48 will maintain air pressure in actuator 28 to hold throttle lever 74 to maintain the engine rpm at the level that produces such pressure. In the event of a drop in pump discharge pressure below the level set for the closing of the circuit to solenoid valve 50 by the pressure differential switch 58 the solenoid valve 50, being a spring biased solenoid valve readily familiar to one skilled in the art will port the air pressure conduits 66 and 28 and therefore chamber 104 in the actuator 28 immediately to vent 106 of controller 50. This will, with very insignificant time delay, allow spring 73, as well as the spring return (not shown) for lever 74 familiar to those skilled in the art, to return the lever 74 to its engine idle position.

It will be readily apparent to those skilled in the art that this disclosure will create distinct advantages for a fire truck pumper equipped with it by eliminating the need to establish a reference pressure for engine throttle control, use of pump pressure as a control medium and the need to reset the system when it is desired to change pump discharge pressure at a fire scene. In addition, this invention will provide automatic response to a simple setting of desired pump discharge pressure and full visual indication of the existing pressure setting. It will also be understood from this disclosure that it is now possible to reduce corrosion, clogging and environmental problems in the control system for actuating an engine throttle and to have a control and supply system that works well in all modes of pumper operation, draft, hydrant or relay.

Having set forth a preferred structure and its operation and advantages it is now desired to set forth the scope of protection sought by these letters patent in an appendage of claims.

I claim:

1. An electro-pneumatic fire pump pressure controller which controller comprises:

an air pressure supply means;

an electrical supply means;

a water supply means;

a pump means connected to said water supply means, said pump means having discharge means for delivery of water under pressure;

a powerplant means connected to said pump means to drive same, said powerplant means having a control means to regulate the powerplant means rpm and thereby the pump means rpm, said control means being biased towards an idle position to maintain a minimum powerplant means rpm when no flow is scheduled by said pump means, said control means being connected to said air pressure supply means;

modulating means interposed in the connection of said control means and said air supply means to operate the said control means with air pressure from said air pressure supply mean;

a differential pressure means connected between said water supply means and said discharge means, said differential pressure means including electrical circuit breaker means that is normally open when said water under pressure at said discharge means is below a predetermined pressure and closed when above said predetermined pressure;

a first switch means connected to said electrical supply means and said differential pressure means;

a second switch means connected to said differential pressure means, said second switch means having a solenoid valve means interposed with said air supply and said modulating means that will port said air supply means to said modulating means upon closure of the electrical circuit breaker of said differential pressure means for actuation of said control means and exhaust said air supply means from said control means when said electrical circuit breaker opens.

2. The controller of claim 1 and further comprising a connection between said discharge means and said modulator means to permit the latter to operate said control means as a function of water pressure from said pump.

3. The controller of claim 2 wherein said modulator means includes adjusting means to vary the control means setting to provide a desired powerplant rpm that will drive the pump means to deliver a desired water pressure.

4. The controller of claim 3 wherein said adjusting means is manually operable.

* * * * *